United States Patent [19]

Knapp, Jr.

[11] 3,962,666

[45] June 8, 1976

[54] SUPPORT PLATES FOR A HELICALLY WOUND FUSIBLE ELEMENT

[75] Inventor: Edward J. Knapp, Jr., Merrimac, Mass.

[73] Assignee: The Chase-Shawmut Company, Newburyport, Mass.

[22] Filed: Apr. 28, 1975

[21] Appl. No.: 571,948

[52] U.S. Cl. ..... 337/159; 337/234; 337/252

[51] Int. Cl.[2] ..... H01H 85/04

[58] Field of Search ..... 337/158, 159, 160, 161, 337/208, 213, 231, 234, 248, 251, 252

[56] References Cited

UNITED STATES PATENTS 2,639,350 5/1953 Cox ..... 337/248 X 3,486,155 12/1969 McCaughna ..... 337/231

FOREIGN PATENTS OR APPLICATIONS 690,991 7/1964 Canada ..... 337/160

*Primary Examiner*—George Harris

*Attorney, Agent, or Firm*—Erwin Salzer

[57] ABSTRACT

Electric fuses having a helically wound fusible element are provided with simple, cost-effective sheet metal means performing the dual function of supporting insulating plates which, in turn, support the helically wound fusible element, and of establishing conductive connections between the ends of the helically wound fusible element and a pair of ferrules by which the casing of the fuse is closed.

5 Claims, 6 Drawing Figures

FIG. 4a FIG. 4b FIG. 4c
upper portion of plate 5a
goes into slot 5b'
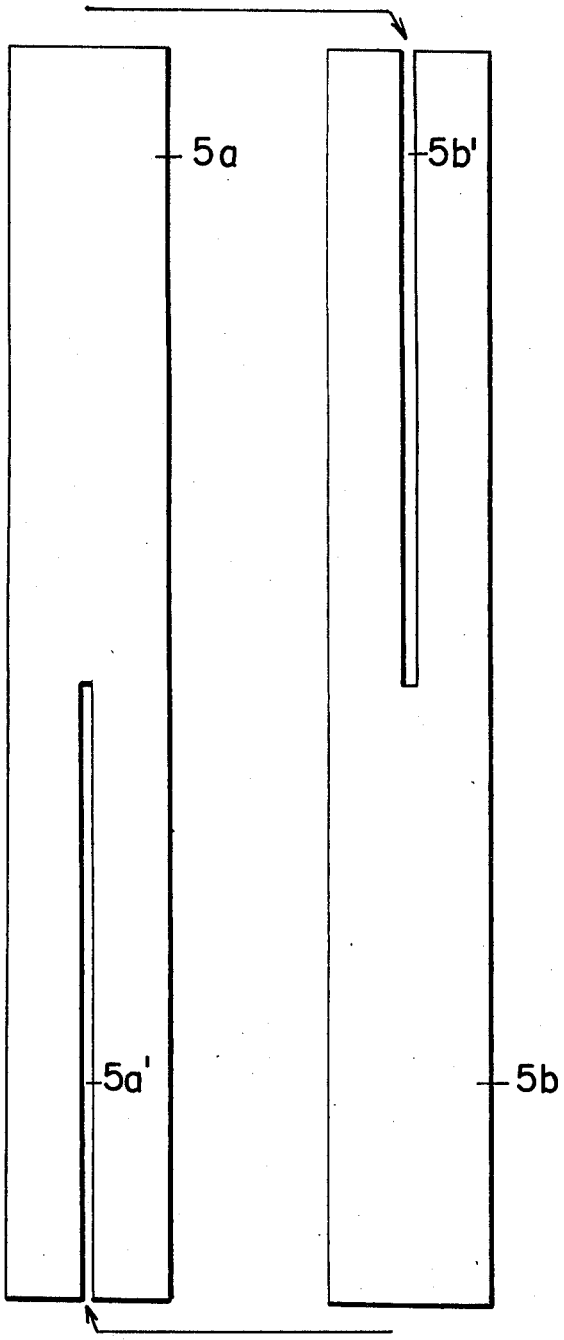
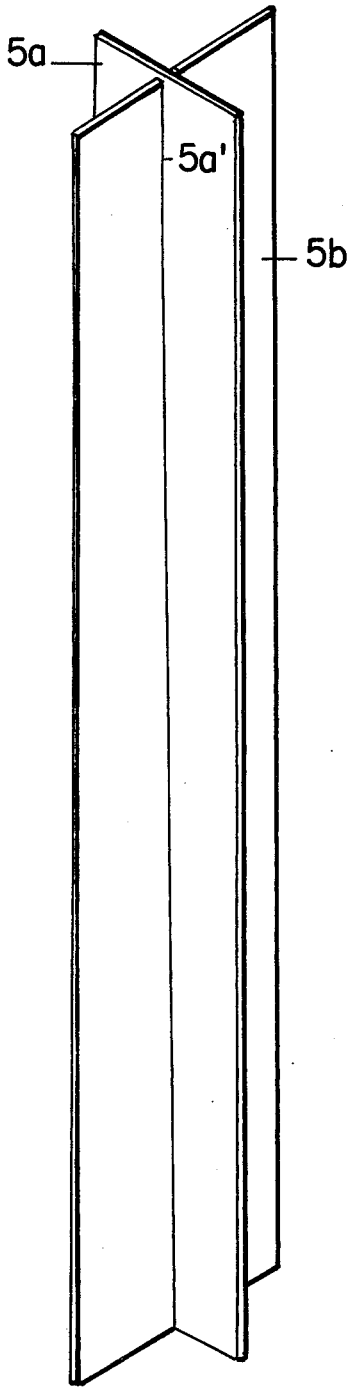
lower portion of plate 5b
goes into slot 5a'

SUPPORT PLATES FOR A HELICALLY WOUND FUSIBLE ELEMENT

BACKGROUND OF THE INVENTION

In electric fuses for elevated circuit voltages it is often necessary to wind the fusible element, or elements, helically around a supporting structure of electric insulating material. Such insulating structures may take various forms, e.g. that of an extruded mandrel. In recent times it has often been found more desirable to fabricate supports for helically wound fusible elements out of plates of insulating material rather than to resort to extruded or similarly formed mandrels. Typical structures of this description are shown in U.S. Pat. No. 3,680,019 to F. J. Kozacka, 7/25/72, for HIGH-VOLTAGE FUSE HAVING A PLURALITY OF FUSE LINKS WOUND HELICALLY AROUND AN INSULATING MANDREL, in U.S. Pat. No. 3,846,728 to E. Salzer, 11/5/74, for HIGH-VOLTAGE FUSE INCLUDING INSULATING MANDREL FOR SUPPORTING FUSIBLE ELEMENTS, and in U.S. Pat. No. 3,851,289 to F. J. Kozacka, 11/26/74, for HIGH-VOLTAGE FUSE HAVING HELICALLY WOUND FUSIBLE ELEMENTS AND SUPPORT FOR HELICALLY WOUND FUSIBLE ELEMENT, all these patents being assigned to the same assignee as the present invention.

The above referred-to prior art relates to fuses wherein the helically wound fusible element extends between a pair of plug terminals.

The present invention relates to fuses wherein the helically wound fusible element extends between a pair of ferrules, or terminal caps, rather than between a pair of plug terminals.

SUMMARY OF THE INVENTION

Fuses embodying this invention include a pair of disks of sheet metal arranged inside the casing or fuse tube adjacent the ends thereof. Each of said pair of disks forms a support for the axially outer ends of plate means of insulating material around the edges of which the fusible element is wound helically. Each of said pair of disks has connector tabs whose ends are interposed between the outer surface of said casing or fuse tube and the inner surfaces of a pair of ferrules supported by the ends of said casing and closing said casing.

BRIEF DESCRIPTION OF THE DRAWINGS

FIGS. 4*a* and 4*b* are front views of insulating plates for forming a mandrel structure for supporting the fusible element and FIG. 4*c* is an isometric view of such a mandrel structure.

DESCRIPTION OF PREFERRED EMBODIMENT

Figure 1:
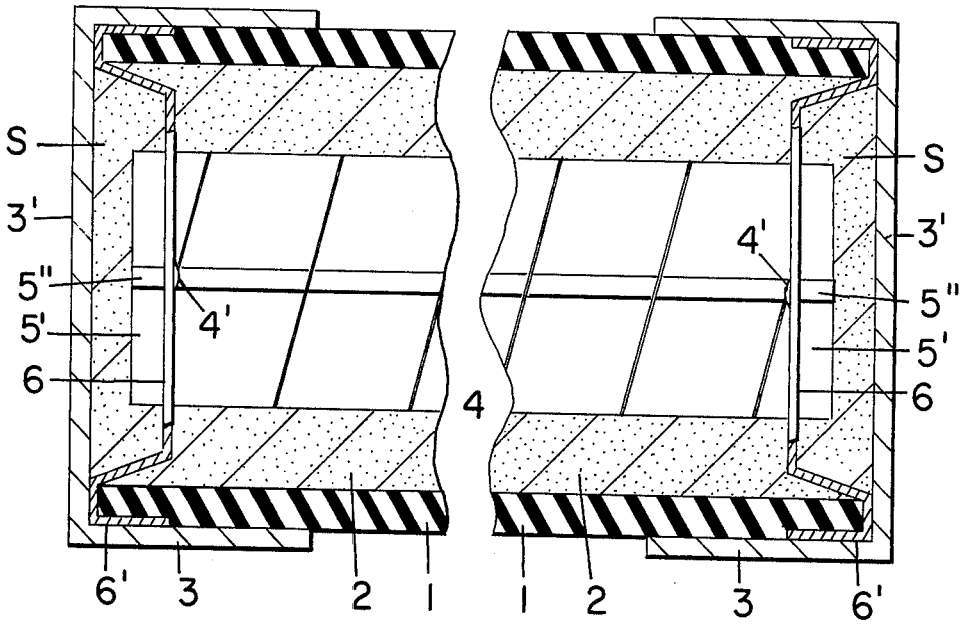
FIG. 1 shows an electric fuse embodying this invention, partly in longitudinal section, and partly in elevation, the center region of the fuse being broken away.
Figure 2:
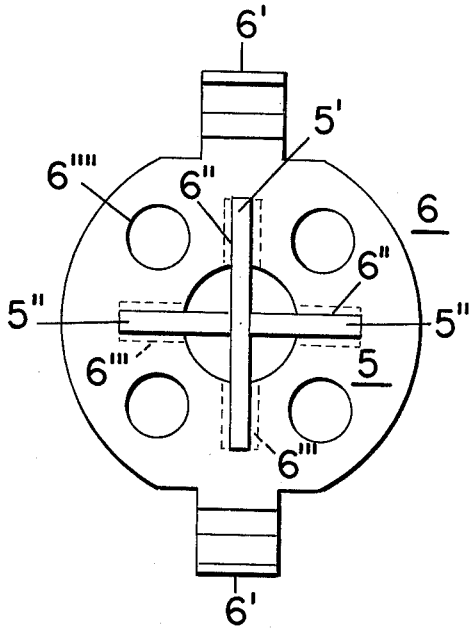
FIG. 2 is an end view of a detail of the structure of FIG. 1 seen in the direction R of FIG. 3.
Figure 3:
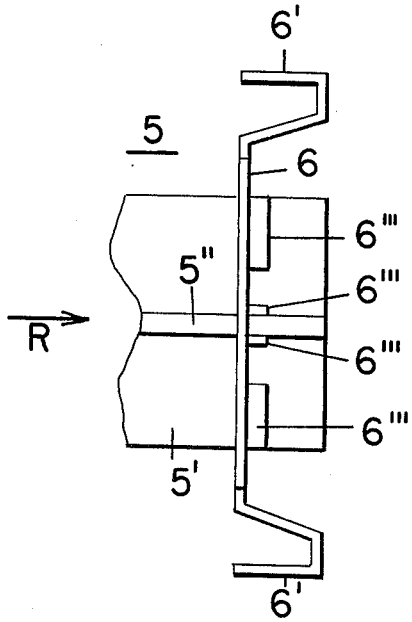
FIG. 3 is a side elevation of the structure shown in FIG. 2.

In the drawings reference numeral 1 has been applied to indicate a tubular casing of electric insulating material, e.g. of a synthetic-resin-glass-cloth laminate. Casing 1 houses a pulverulent arc-quenching filler 2 such as, for instance, quartz sand. A pair of ferrules or terminal caps 3 is supported by the ends of casing 1 and closes the latter. Reference numeral 4 has been applied to indicate a helically wound fusible element inside of casing 1, embedded in filler 2, conductively interconnecting the pair of ferrules 3. How this is achieved will be explained below in more detail. Reference numeral 5 has been applied to generally designate plate means of electric insulating material arranged inside casing 1 having edges extending in a direction longitudinally thereof supporting helically wound fusible element 4. The latter may either be in the form of a wire — as shown in FIG. 1 — or in form of a metal ribbon. In the embodiment of the invention shown in the drawing plate means 5 are made up of a relatively wide plate 5' and two relatively narrow plates 5''. The latter are arranged at right angles to the plane defined by wide plate 5', at opposite sides of wide plate 5', and cemented to the latter with their edges situated adjacent to plate 5'. A pair of sheet metal disks 6 are arranged inside casing 1 adjacent the ends thereof. In FIG. 1 the disks 6 have been shown in part in elevation and in part in section. Each of the pair of disks 6 forms a support for the axially outer ends of plate means 5 and each of the pair of disks 6 has connector tabs 6' whose ends are interposed between the outer surface of casing 1 and the inner surface of one of ferrules 3. The ends of fusible element 4 are conductively connected by solder joints 4' to disks 6. Connector tabs 6' are bent around the axially outer edges or rims of casing 1 and conductively connected to ferrules 3 by means well known in the art to achieve this end, e.g. solder joints. To minimize the weight of disks 6 the latter are provided with four circular apertures or holes 6''''. Each of the pair of disks 6 is arranged adjacent, parallel to, and in spaced relation from, the end surface 3' of one of ferrules 3. Each of disks 6 is provided with slot means or slots 6'' and plate means 5 project through slots 6'' into spaces S bounded by the end surfaces 3' of ferrules 3 and by disks 6. This greatly increases the dimensional stability of the mandrel structure formed by parts 5', 5'' supporting fusible element 4. The dimensional stability of that mandrel structure is further increased by tabs 6''' engaging the sides of plate means 5. Tabs 6''' are formed by portions of disks 6 partly stamped out of the planes defined by disks 6 to establish slots 6''. Tabs 6''' enclose angles of 90 degrees with the respective plane defined by each of disks 6.

As mentioned above, the weight of disks 4 is minimized by the circular apertures or holes 6'''' therein. The apertures or holes 6'''' facilitate also filling of casing 1 with pulverulent arc-quenching filler.

Plates 5' and 5'' may be joined together by adhesive means when the production volume is relatively small. Where the production volume is relatively large, the plate means 5 are preferably formed by a pair of slotted plates 5*a*,5*b* as shown in FIGS. 4*a* and 4*b* in front elevation. Plate 5*a* is provided with a slot 5*a'* extending in a direction longitudinally thereof and having an opening at the lower narrow edge of plate 5*a*. Plate 5*b* is provided with a slot 5*b'* extending in a direction longitudinally thereof and having an opening at the upper narrow edge of plate 5*b*. Plates 5*a*,5*b* are arranged at right angles in such a way that the upper portion of plate 5*b* is arranged inside the slot 5*a'* of plate 5*a* and that the lower portion of plate 5*b* is arranged inside of the slot 5*b'* of plate 5*b*.

I claim as my invention:

1. An electric fuse including a. a tubular casing of electric insulating material;

b. a pulverulent arc-quenching filler inside said casing;

c. a pair of ferrules supported by the ends of said casing and closing said casing;

d. a helically wound fusible element inside said casing embedded in said filler conductively interconnecting said pair of ferrules;

e. plate means of electric insulating material inside said casing having edges extending in a direction longitudinally thereof supporting said helically wound fusible element; and f. a pair of disks of sheet metal arranged inside said casing adjacent the ends thereof, each of said pair of disks forming a support for the axially outer ends of said plate means and each of said pair of disks having connector tabs whose ends are interposed between the outer surface of said casing and the inner surface of one of said pair of ferrules, each of said pair of disks being arranged adjacent, parallel to, and in spaced relation from, an end surface of one of said pair of ferrules, and each of said pair of disks being provided with slot means and said plate means projecting through said slot means axially outwardly into a space bounded by said end surface of one of said pair of ferrules and by one of said pair of disks.

2. An electric fuse as specified in claim 1 wherein said pair of disks forms tabs engaging the sides of said plate means.

3. An electric fuse as specified in claim 1 wherein at least one of said pair of disks is provided with a plurality of perforations adapted for filling said pulverulent arc-quenching filler into said casing.

4. An electric fuse as specified in claim 1 wherein said plate means include a pair of plates each having a slot extending in a direction longitudinally thereof and each open at one end and closed on the other end, each of said pair of plates projecting at right angles through said slot in the other of said pair of plates.

5. An electric fuse including a. a tubular casing of electric insulating material;

b. a pulverulent arc-quenching filler inside said casing;

c. a pair of terminal caps mounted on the ends of said casing and closing said casing;

d. a helically wound fusible element inside said casing embedded in said filler conductively interconnecting said pair of terminal caps;

e. a plurality of angularly displaced plate means of electric insulating material inside said casing having edges extending in a direction longitudinally thereof supporting said helically wound fusible element; and f. a pair of disks of sheet metal arranged inside said casing adjacent the ends thereof, each of said pair of disks forming a support for the axially outer ends of said plate means and each of said pair of disks having connector tabs connected to said pair of terminal caps, each of said pair of disks being arranged adjacent, parallel to, and in spaced relation from, an end surface of one of said pair of terminal caps, each of said pair of disks being provided with slot means engaged by transverse edges of said plate means, and at least one of said pair of disks being provided with a plurality of perforations adapted for filling said pulverulent arc-quenching filler into said casing.

* * * * *